US010372052B2

(12) United States Patent
Zwartz et al.

(10) Patent No.: US 10,372,052 B2
(45) **Date of Patent: *Aug. 6, 2019**

(54) CURABLE TONER COMPOSITIONS AND PROCESSES

(71) Applicant: Xerox Corporation, Norwalk, CT (US)

(72) Inventors: Edward G. Zwartz, Mississauga (CA); Guerino G. Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 12 days.

This patent is subject to a terminal disclaimer.

(21) Appl. No.: 15/219,816

(22) Filed: Jul. 26, 2016

(65) Prior Publication Data

US 2016/0334721 A1 Nov. 17, 2016

Related U.S. Application Data

(63) Continuation of application No. 12/553,306, filed on Sep. 3, 2009.

(51) Int. Cl.

| | |
|---|---|
| ***G03G 9/08*** | (2006.01) |
| ***G03G 9/093*** | (2006.01) |
| ***G03G 15/20*** | (2006.01) |
| ***G03G 9/087*** | (2006.01) |

(52) U.S. Cl.

CPC ..... *G03G 9/0804* (2013.01); *G03G 9/0806* (2013.01); *G03G 9/0819* (2013.01); *G03G 9/0825* (2013.01); *G03G 9/08755* (2013.01); *G03G 9/08795* (2013.01); *G03G 9/08797* (2013.01); *G03G 9/09328* (2013.01); *G03G 9/09371* (2013.01); *G03G 15/20* (2013.01); *G03G 2215/0604* (2013.01)

(58) Field of Classification Search

CPC ..... G03G 9/08; G03G 9/0804; G03G 15/20; G03G 9/09328; G03G 9/0825

USPC ..... 430/124.4, 137.14

See application file for complete search history.

(56) References Cited

U.S. PATENT DOCUMENTS

| | | | | |
|---|---|---|---|---|
| 2004/0131962 | A1* | 7/2004 | Nakamura | G03G 9/08755 430/108.21 |
| 2007/0003856 | A1* | 1/2007 | Farrugia | G03G 9/0804 430/110.2 |
| 2007/0272309 | A1* | 11/2007 | Rehm | B01L 3/502738 137/528 |
| 2008/0199797 | A1* | 8/2008 | Sacripante | G03G 9/0804 430/104 |
| 2010/0285401 | A1* | 11/2010 | Sacripante | G03G 9/0806 430/105 |

* cited by examiner

*Primary Examiner* — Stewart A Fraser
*Assistant Examiner* — Rachel L Zhang
(74) *Attorney, Agent, or Firm* — Marylou J. Lavoie, Esq. LLC

(57) ABSTRACT

An emulsion aggregation toner composition includes toner particles including: an unsaturated polymeric resin, such as amorphous resins, crystalline resins, and combinations thereof; an optional colorant; an optional wax; an optional coagulant; and a photoinitiator. By optimizing the particle size of the emulsion, the aggregant concentration utilized in the emulsion aggregation process, and the solids content of the emulsion, toners may be produced capable of generating images with non-contact fusing that have high gloss.

17 Claims, 3 Drawing Sheets

CURABLE TONER COMPOSITIONS AND PROCESSES

CROSS-REFERENCE TO RELATED APPLICATIONS

This application is a continuation of U.S. application Ser. No. 12/553,306, filed Sep. 3, 2009, U. S. Publication Number US-2011-0053078-A1, the disclosure of which is totally incorporated by reference herein.

Reference is made to Copending application Ser. No. 14/933,680, filed Nov. 5, 2015, entitled "Curable Toner Compositions And Processes," with the named inventors Edward Graham Zwartz and Guerino G. Sacripante, the disclosure of which is totally incorporated herein by reference.

BACKGROUND

This disclosure is generally directed to toner processes, and more specifically, emulsion aggregation and coalescence processes, as well as toner compositions formed by such processes and development processes using such toners.

Emulsion aggregation/coalescing processes for the preparation of toners are illustrated in a number of Xerox patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817.

The disclosures of each of the foregoing patents and publications are hereby incorporated by reference herein in their entireties. The appropriate components and process aspects of the each of the foregoing patents and publications may also be selected for the present compositions and processes in embodiments thereof.

In a number of electrophotographic engines and processes, toner images may be applied to substrates. The toners may then be fused to the substrate by heating the toner with a contact fuser or a non-contact fuser, wherein the transferred heat melts the toner mixture onto the substrate. Electrophotographic digital printing with current toners can produce a range of print gloss when fused using contact fusers such as rolls or belt based fusing sub-systems. The desired gloss level depends on specific customer applications. To date, toners that are fused with non-contact fusing sub-systems such as flash fusing, radiant fusing or steam fusing sub-systems produce prints that are matte or require very long (2 second) dwell times.

Toners that are fixed to paper with non-contact fusing having high print gloss with short dwell times remain desirable.

SUMMARY

The present disclosure provides processes for producing toners and toners produced by such methods. In embodiments, a process of the present disclosure includes contacting an emulsion including at least one polymeric resin comprising particles of a size of from about 80 nanometers to about 120 nanometers with an optional colorant, and an optional wax; aggregating the particles by contacting the particles with from about 0.01 to about 0.35 parts per hundred of an aggregating agent to form aggregated particles; contacting the aggregated particles with at least one unsaturated polymeric resin in combination with a photoinitiator to form a shell over the aggregated particles; coalescing the aggregated particles to form toner particles; and recovering the toner particles of a size of from about 3 microns to about 4 microns.

In embodiments, a process of the present disclosure includes contacting an emulsion including at least one polymeric resin comprising particles of a size of from about 80 nanometers to about 120 nanometers with an optional colorant, and an optional wax; aggregating the particles by contacting the particles with from about 0.01 to about 0.35 parts per hundred of an aggregating agent to form aggregated particles; contacting the aggregated particles with at least one unsaturated polymeric resin in combination with a photoinitiator to form a shell over the aggregated particles; coalescing the aggregated particles to form toner particles; recovering the toner particles; applying the toner particles to a substrate; and fusing the toner particles to the substrate by non-contact fusing to form an image on the substrate, wherein the toner possesses a gloss of from about 20 ggu to about 100 ggu.

Printing apparatus utilizing such toners are also provided. In embodiments, a printing apparatus of the present disclosure may include at least one heating device, such as an optional contact fuser; a non-contact fuser; a substrate pre-heater; an image bearing member pre-heater; and a transfuser, wherein the non-contact fuser comprises a source of infrared light operating at a wavelength of from about 750 nm to about 2500 nm.

BRIEF DESCRIPTION OF THE DRAWINGS

Various embodiments of the present disclosure will be described herein below with reference to the figures wherein.

DETAILED DESCRIPTION

Figure 1:
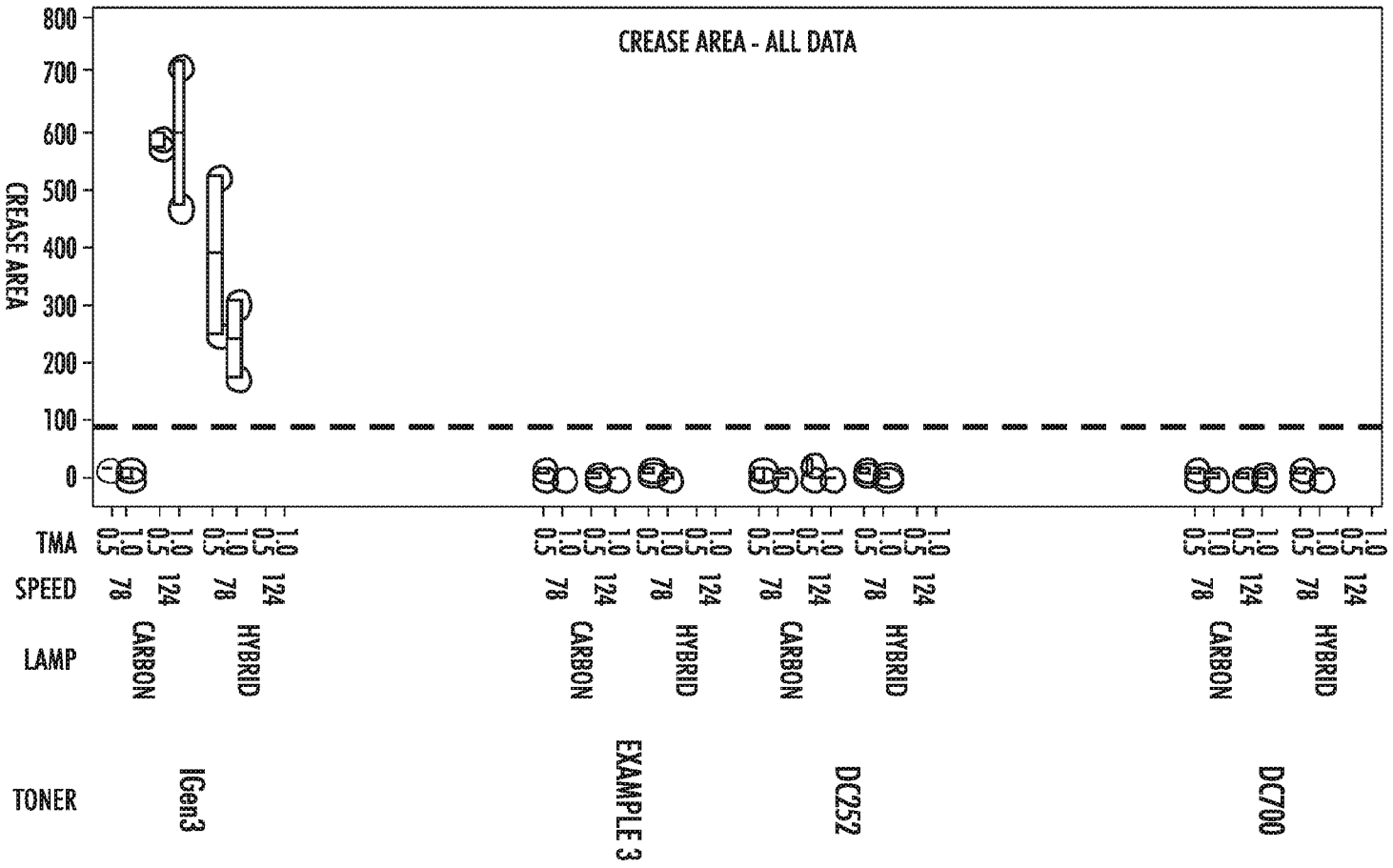
FIG. 1 is a graph of results of crease area testing conducted on a toner of the present disclosure and comparison toners.

The present disclosure provides a toner design for non-contact fusing that produces high print gloss in short dwell times. To date, toners that are fused with non-contact fusing sub-systems such as flash/radiant fusing produce prints that are matte or require very long (2 second) dwell times. In embodiments the present disclosure is directed to curable toner compositions, including those made by a chemical process such as emulsion aggregation, wherein the resultant toner composition includes an unsaturated polyester resin, a photoinitiator, optionally a wax, and optionally a colorant.

Processes of the present disclosure may include aggregating latex particles, such as latexes containing an unsaturated resin such as unsaturated crystalline or amorphous polymeric particles such as polyesters, a photoinitiator, optionally a wax, and optionally a colorant, in the presence of a coagulant.

A number of advantages are associated with the toner obtained by the processes and toner compositions illustrated herein. The process allows for particles to be prepared in the size of 2.5 to 4.2 microns in diameter, in embodiments from about 3 to about 4, in embodiments about 3.5, with narrow size distributions, such as from about 1.2 to about 1.25, without the use of classifiers. Furthermore, low melting or ultra-low melting fixing temperatures can be obtained by the use of crystalline resins in the toner composition. The aforementioned low fixing temperatures allow for the curing by ultraviolet light to occur at lower temperatures, such as from about 120° C. to about 135° C. The toner compositions provide other advantages, such as high temperature document offset properties, such as up to about 85° C., as well as resistance to organic solvents such as methyl ethyl ketone (MEK).

In embodiments, toners prepared in accordance with the present disclosure may be UV curable low melt EA toners including an unsaturated resin, UV initiator and a shell. Adding a photoinitiator to the resin may produce a UV curable toner. While toners of the present disclosure may include photoinitiators used with UV light, it has been found that UV curing may not be required as non-contact fusing with different wavelength infrared (IR) emitters may occur at different process speeds and high gloss prints may still be generated.

In accordance with the present disclosure, the desired toners may be obtained by optimizing the particle size of the emulsion, the use of an appropriate aggregating agent, and the solids content.

Resin.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid or diester in the presence of an optional catalyst. For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly (butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly (decylene-sebacate), poly(decylene-decanoate), poly-(ethylene-decanoate), poly-(ethylene-dodecanoate), poly (nonylene-sebacate), poly (nonylene-decanoate), copoly (ethylene-fumarate)-copoly(ethylene-sebacate), copoly (ethylene-fumarate)-copoly(ethylene-decanoate), copoly (ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. In embodiments, the amorphous resin utilized in the core may be linear.

In embodiments, a suitable amorphous polyester resin may be a poly(propoxylated bisphenol A co-fumarate) resin having the following formula (1):

(I)

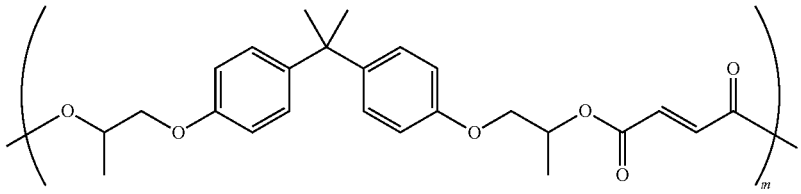

wherein m may be from about 5 to about 1000, although m can be outside of this range.

Examples of such resins and processes for their production include those disclosed in U.S. Pat. No. 6,063,827, the disclosure of which is hereby incorporated by reference in its entirety.

In embodiments, a suitable amorphous resin utilized in a toner of the present disclosure may have a molecular weight of from about 10,000 to about 100,000, in embodiments from about 15,000 to about 30,000.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(II)

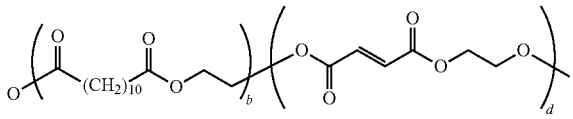

wherein b is from about 5 to about 2000 and d is from about 5 to about 2000.

In embodiments, a suitable crystalline resin utilized in a toner of the present disclosure may have a molecular weight of from about 10,000 to about 100,000, in embodiments from about 15,000 to about 30,000.

One, two, or more resins may be used in forming a toner. In embodiments where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

In embodiments, a suitable toner of the present disclosure may include 2 amorphous polyester resins and a crystalline polyester resin. The weight ratio of the three resins may be from about 29% first amorphous resin/69% second amorphous resin/2% crystalline resin, to about 60% first amorphous resin/20% second amorphous resin/20% crystalline resin.

As noted above, in embodiments, the resin may be formed by emulsion aggregation methods. Utilizing such methods, the resin may be present in a resin emulsion, which may then be combined with other components and additives to form a toner of the present disclosure.

The polymer resin may be present in an amount of from about 65 to about 95 percent by weight, or preferably from about 75 to about 85 percent by weight of the toner particles (that is, toner particles exclusive of external additives) on a solids basis. The ratio of crystalline resin to amorphous resin can be in the range from about 1:99 to about 30:70, such as from about 5:95 to about 25:75.

It has also been found that a polymer with a low acid number provides better crosslinking results under irradiation. For example, it is desired in embodiments that the acid number of the polymer be from about 5 to about 30 mg KOH/gram, in embodiments from about 10 to about 20 mg KOH/gram, in embodiments about 15 mg KOH/gram.

An emulsion possessing an unsaturated polymeric resin may be utilized to produce a toner. Such an emulsion may possess polymeric resins having particles of a size of from about 80 nanometers to about 120 nanometers, in embodiments from about 90 nanometers to about 110 nanometers.

Photoinitiator.

To enable curing of the unsaturated polymer, the toners of the present disclosure may also contain a photoinitiator. Suitable photoinitiators include UV-photoinitiators including, but not limited to, hydroxycyclohexylphenyl ketones; other ketones such as alpha-amino ketone and 4-(2-hydroxyethoxy)phenyl-(2-hydroxy-2-propyl) ketone; benzoins; benzoin alkyl ethers; benzophenones, such as 2,4,6-trimethylbenzophenone and 4-methylbenzophenone; trimethylbenzoylphenylphosphine oxides such as 2,4,6-trimethylbenzoyl-diphenyl-phosphine oxide or phenylbis(2,4,6-trimethylbenzyoyl) phosphine oxide (BAPO) available as IRGACURE® 819 from Ciba; azo compounds; anthraquinones and substituted anthraquinones, such as, for example, alkyl substituted or halo substituted anthraquinones; other substituted or unsubstituted polynuclear quinines; acetophenones, thioxanthones; ketals; acylphosphines; and mixtures thereof. Other examples of photoinitiators include, but not limited to, 2-hydroxy-2-methyl-1-phenyl-propan-1-one and 2-isopropyl-9H-thioxanthen-9-one. In embodiments, the photoinitiator is one of the following compounds or a mixture thereof: a hydroxycyclohexylphenyl ketone, such as, for example, 2-Hydrox-4'-hydroxyethoxy-2-methylpropiophenone or 1-hydroxycyclohexylphenyl ketone, such as, for example, IRGACURE® 184 (Ciba-Geigy Corp., Tarrytown, N.Y.), having the structure:

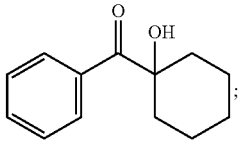

a trimethylbenzoylphenylphosphine oxide, such as, for example, ethyl-2,4,6-trimethylbenzoylphenylphosphinate, such as, for example, LUCIRIN® TPO-L (BASF Corp.), having the formula

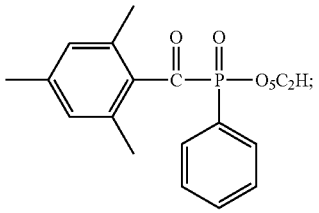

a mixture of 2,4,6-trimethylbenzophenone and 4-methylbenzophenone, such as, for example, SARCURE™ SR1137 (Sartomer); a mixture of 2,4,6-trimethylbenzoyl-diphenylphosphine oxide and 2-hydroxy-2-methyl-1-phenyl-propan-1-one, such as, for example, DAROCUR® 4265 (Ciba Specialty Chemicals); alpha-amino ketone, such as, for example, IRGACURE® 379 (Ciba Specialty Chemicals); 4-(2-hydroxyethoxy)phenyl-(2-hydroxy-2-propyl) ketone, such as, for example, IRGACURE® 2959 (Ciba Specialty Chemicals); 2-isopropyl-9H-thioxanthen-9-one, such as, for example, DAROCUR® ITX (Ciba Specialty Chemicals); and mixtures thereof.

In embodiments, the toner composition contains from about 0.5 to about 15 wt % photoinitiator, such as a UV-photoinitiator, in embodiments from about 1 to about 14 wt %, or from about 3 to about 12 wt %, photoinitiator.

Toner.

The resin of the resin emulsions described above, in embodiments a polyester resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants.

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL C0-890™, IGEPAL C0-720™, IGEPAL C0-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™ NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetylpyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants.

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites M08029™, M08060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLQW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.1. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2GO1 (American Hoechst), Sunsperse Blue BHD 6000 (Sun Chemicals), lrgalite Blue BCA (Ciba-Geigy), Paliogen Blue 6470 (BASF), Sudan III (Matheson, Coleman, Beln, Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow 00790 (BASF), Sunsperse Yellow YHD 6001 (Sun Chemicals), Suco-Gelb L1250 (BASF), Suco-Yellow 01355 (BASF), Hostaperm Pink E (American Hoechst), Fanal Pink 04830 (BASF), Cinquasia Magenta (DuPont), Lithol Scarlet 03700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red R.D-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax.

In addition to the polymer binder resin and photoinitiator, the toners of the present disclosure also optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Optionally, a wax may also be combined with the resin and UV additive in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation.

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion (s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. In embodiments, the amount of aggregating agent added may be from about 0.01 parts per hundred to about 0.35 parts per hundred, in embodiments from about 0.1 parts per hundred to about 0.3 parts per hundred. This provides a sufficient amount of agent for aggregation.

The gloss of a toner may be influenced by the amount of retained metal ion, such as $Al^{3+}$, in the particle. The amount of retained metal ion may be further adjusted by the addition of EDTA. In embodiments, the amount of retained cross-linker, for example $Al^{3+}$, in toner particles of the present disclosure may be from about 0.1 pph to about 1 pph, in embodiments from about 0.25 pph to about 0.8 pph, in embodiments about 0.5 pph.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Resin.

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration.

The shell resin may be present in an amount of from about 20 percent to about 45 percent by weight of the toner particles, in embodiments from about 28 percent to about 36 percent by weight of the toner particles. In embodiments a photoinitiator as described above may be included in the shell. Thus, the photoinitiator may be in the core, the shell, or both. The photoinitiator may be present in an amount of from about 1 percent to about 10 percent by weight of the toner particles, in embodiments preferably from about 2 percent to about 5 percent by weight of the toner particles.

Emulsions of the present disclosure including the resins described above and optional additives may possess particles having a size of from about 80 nm to about 120 nm, in embodiments from about 105 nm to about 125 nm, in some embodiments about 110 nm.

Emulsions including these resins may have a solids loading of from about 15% solids by weight to about 50% solids by weight, in embodiments from about 17% solids by weight to about 40% solids by weight, in embodiments about 20% solids by weight.

Once the desired final size of the toner particles is achieved, the pH of the mixture may be adjusted with a base to a value of from about 6 to about 10, and in embodiments from about 6.2 to about 7. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylenediamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

Coalescence.

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours, although periods of time outside of these ranges can be used.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives.

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner, although amounts outside these ranges can be used. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

The characteristics of the toner particles may be determined by any suitable technique and apparatus. Volume average particle diameter Dsov.GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toner particles thus produced may have a diameter of from about 3 microns to about 4 microns, in embodiments from about 3.25 microns to about 3.75 microns.

Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −35 μC/g, and a final toner charging after surface additive blending of from −10 μC/g to about −45 μC/g.

Utilizing the methods of the present disclosure, desirable gloss levels may be obtained. Thus, for example, the gloss level of a toner of the present disclosure may have a gloss as measured by Gardner Gloss Units (ggu) of from about 20 ggu to about 100 ggu, in embodiments from about 50 ggu to about 95 ggu, in embodiments from about 60 ggu to about 80 ggu.

In embodiments, toners of the present disclosure may be utilized as ultra low melt (ULM) toners. In embodiments, the dry toner particles, exclusive of external surface additives, may have the following characteristics:

(1) Number Average Geometric Standard Deviation (GSDn) and/or Volume Average Geometric Standard Deviation (GSDv) of from about 1.05 to about 1.55, in embodiments from about 1.1 to about 1.4.

(2) Circularity of from about 0.9 to about 1 (measured with, for example, a Sysmex FPIA 2100 analyzer), in embodiments form about 0.95 to about 0.985, in other embodiments from about 0.96 to about 0.98.

(3) Glass transition temperature of from about 35° C. to about 60° C., in embodiments from about 37° C. to about 45° C.

(4) The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It may be desirable in embodiments that the toner particle possess separate crystalline polyester and wax melting points and amorphous polyester glass transition temperature as measured by DSC, and that the melting temperatures and glass transition temperature are not substantially depressed by plasticization of the amorphous or crystalline polyesters, or by the photoinitiator, or by the wax. To achieve non-plasticization, it may be desirable to carry out the emulsion aggregation at a coalescence temperature of less than the melting point of the crystalline component, photoinitiator and wax components.

Developers.

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers.

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, availablfor example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging.

The toners can be utilized for electrostatographic or electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In embodiments, the fusing of the toner image can be conducted by any conventional means, such as combined heat and pressure fusing such as by the use of heated pressure rollers. Such fusing steps can include an irradiation step, such as an ultraviolet irradiation step, for activating the photoinitiator and causing crosslinking or curing of the unsaturated polymer contained in the toner composition. This irradiation step can be conducted, for example, in the same fusing housing and/or step where conventional fusing is conducted, or it can be conducted in a separate irradiation fusing mechanism and/or step. In some embodiments, this irradiation step may provide non-contact fusing of the toner, so that conventional pressure fusing may not be required.

For example, in embodiments, the irradiation can be conducted in the same fusing housing and/or step where conventional fusing is conducted. In embodiments, the irradiation fusing can be conducted substantially simultaneously with conventional fusing, such as be locating an irradiation source immediately before or immediately after a heated pressure roll assembly. Desirably, such irradiation is located immediately after the heated pressure roll assembly, such that crosslinking occurs in the already fused image.

In other embodiments, the irradiation can be conducted in a separate fusing housing and/or step from a conventional fusing housing and/or step. For example, the irradiation fusing can be conducted in a separate housing from the conventional such as heated pressure roll fusing. That is, the conventionally fused image can be transported to another development device, or another component within the same development device, to conduct the irradiation fusing. In this manner, the irradiation fusing can be conducted as an optional step, for example to irradiation cure images that require improved high temperature document offset properties, but not to irradiation cure images that do not require such improved high temperature document offset properties. The conventional fusing step thus provides acceptable fixed image properties for moist applications, while the optional irradiation curing can be conducted for images that may be exposed to more rigorous or higher temperature environments.

In other embodiments, the toner image can be fused by irradiation and optional heat, without conventional pressure fusing. This may be referred to, in embodiments, as non-contact fusing. The irradiation fusing can be conducted by any suitable irradiation device, and under suitable parameters, to cause the desired degree of crosslinking of the unsaturated polymer. Suitable non-contact fusing methods are within the purview of those skilled in the art and include, in embodiments, UV (ultraviolet) fusing, e-beam (electron beam), flash fusing, radiant fusing, and/or steam fusing.

In embodiments, the energy source for fusing can be actinic, such as radiation having a wavelength in the ultraviolet or visible region of the spectrum, accelerated particles, such as electron beam radiation, thermal such as heat or infrared radiation, or the like. In embodiments, the energy may be actinic radiation. Suitable sources of actinic radiation include, but are not limited to, mercury lamps, xenon lamps, carbon arc lamps, tungsten filament lamps, lasers, sunlight, and the like.

In embodiments, non-contact fusing may occur by exposing the toner to infrared light at a wavelength of from about 750 nm to about 2500 nm, in embodiments from about 800 to about 2000, for a period of time of from about 30 milliseconds to about 3 seconds, in embodiments from about 100 milliseconds to about 1 second.

Where heat is also applied, the image can be fused by irradiation such as by infrared light, in a heated environment such as from about 100 to about 250° C., such as from about 125 to about 225° C. or from about 150 or about 160 to about 180 or about 190° C.

Exemplary apparatuses for producing these images may include, in embodiments, a heating device possessing heating elements, an optional contact fuser, a non-contact fuser such as a radiant fuser, an optional substrate pre-heater, an image bearing member pre-heater, and a transfuser. Examples of such apparatus include those disclosed in U.S. Pat. No. 7,141,761, the disclosure of which is hereby incorporated by reference in its entirety.

When the irradiation fusing is applied to the photoinitiator-containing toner composition, the resultant fused image is provided with non document offset properties, that is, the image does not exhibit document offset, at temperature up to about 90° C., such as up to about 85° C. or up to about 80° C. The resultant fused image also exhibits improved abrasion resistance and scratch resistance as compared to conventional fused toner images. Such improved abrasion and scratch resistance is beneficial, for example, for use in producing book covers, mailers, and other applications where abrasion and scratches would reduce the visual appearance of the item Improved resistance to solvents is also provided, which is also beneficial for such uses as mailers, and the like. These properties are particularly helpful, for example, for images that must withstand higher temperature environments, such as automobile manuals that typically are exposed to high temperatures in glove compartments or printed packaging materials that must withstand heat sealing treatments.

In embodiments, UV radiation may be separately applied. Ultraviolet radiation, in embodiments from a medium pressure mercury lamp with a high speed conveyor under UV light, such as about 20 to about 70 m/min, can be used, wherein the UV radiation is provided at a wavelength of about 200 to about 500 run for about less than one second, although the disclosure is not limited thereto. In embodiments, the speed of the high speed conveyor can be about 15 to about 35 m/min under UV light at a wavelength of about 200 to about 500 nm for about 10 to about 50 milliseconds (ms). The emission spectrum of the UV light source generally overlaps the absorption spectrum of the UV-initiator. Optional curing equipment includes, but is not limited to, a reflector to focus or diffuse the UV light, and a cooling system to remove heat from the UV light source. Of course, these parameters are exemplary only, and the embodiments are not limited thereto. Further, variations in the process can include such modifications as light source wavelengths, optional pre-heating, alternative photoinitiators including use of multiple photoinitiators, and the like.

It is envisioned that the toners of the present disclosure may be used in any suitable procedure for forming an image with a toner, including in applications other than xerographic applications.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

Preparation of an amorphous resin-photoinitiator emulsion. About 816.67 grams of ethyl acetate was added to about 125 grams of a poly(propoxylated bisphenol A co-fumarate) resin having the following formula (I):

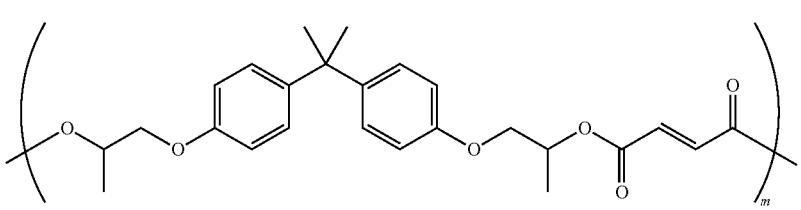

(I)

wherein m may be from about 5 to about 1000, with a glass transition temperature of about 56° C. The resin was dissolved by heating to about 65° C. on a hot plate and stirring at about 200 rpm. About 100 grams of ethyl acetate was added to about 3.75 grams of phenylbis(2,4,6-trimethylbenzyoyl) phosphine oxide (BAPO, available as IRGACURE 819) (3% by weight of resin). The BAPO was dissolved by heating to about 65° C. on a hot plate and stirring at about 200 rpm. Once both solutions had reached about 65° C., the BAPO solution was added to the resin solution.

In a separate 4 liter glass reactor vessel, about 3.05 grams (for an acid number of about 17) of sodium bicarbonate was added to about 708.33 grams of deionized water. This aqueous solution was heated to about 65° C. on a hot plate stirring at about 200 rpm. The dissolved resin, BAPO, and ethyl acetate mixture was slowly poured into the 4 liter glass reactor containing this aqueous solution with homogenization at about 4,000 rpm. The homogenizer speed was then increased to about 10,000 rpm and left for about 30 minutes. The homogenized mixture was placed in a heat jacketed PYREX distillation apparatus, with stirring at about 200 rpm. The temperature was ramped up to about 80° C. at a rate of about 1° C./minute. The ethyl acetate was distilled from the mixture at about 80° C. for about 120 minutes. The mixture was cooled to below about 40° C. then screened through a 20 micron screen. The mixture was pH adjusted to about 7 using 4% NaOH solution and centrifuged. The resulting resin included about 24.5% solids by weight in water, with a volume average diameter of about 110 nanometers as measured with a HONEYWELL MICROTRAC® UPA150 particle size analyzer.

Example 2

Preparation of a crystalline resin emulsion including a crystalline polyester resin, copoly(ethylen dodecanoate)-copoly-(ethylene-fumarate), derived from dodecanedioic acid, ethylene glycol and fumaric acid, having the general formula:

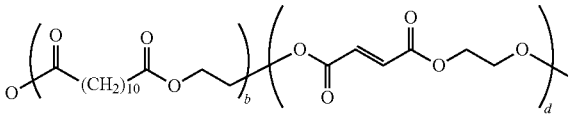

wherein b was from about 5 to about 2000 and d was from about 5 to about 2000.

A one liter Parr reactor equipped with a heating mantle, mechanical stirrer, bottom drain valve and distillation apparatus was charged with dodecanedioic acid (about 443.6 grams), fumaric acid (about 18.6 grams), hydroquinone (about 0.2 grams), n-butylstannoic acid (FASCAT 4100) catalyst (about 0.7 grams), and ethylene glycol (about 248 grams). The materials were stirred and slowly heated to about 150° C. over about 1 hour under a stream of $CO_2$. The temperature was then increased by about 15° C. and subsequently about 10° C. intervals, about every 30 minutes to about 180° C. During this time, water was distilled as a by product. The temperature was then increased by about 5° C. intervals over about a 1 hour period to about 195° C. The pressure was then reduced to about 0.03 mbar over about a 2 hour period and any excess glycols were collected in the distillation receiver. The resin was returned to atmospheric pressure under a stream of $CO_2$ and then trimellitic anhydride (about 12.3 grams) was added. The pressure was slowly reduced to about 0.03 mbar over about 10 minutes and held there for about another 40 minutes. The crystalline resin, copoly(ethylene-dodecanoate)-copoly-(ethylene-fumarate), was returned to atmospheric pressure and then drained through the bottom drain valve to give a resin with a viscosity of about 87 Pa·s (measured at about 85° C.), an onset melting of about 69° C., melt point temperature peak of about 78° C., and recrystalization peak on cooling of about 56° C. as measured by a Dupont Differential Scanning calorimeter. The acid value of the resin was found to be about 12 meq/KOH.

About 816.67 grams of ethyl acetate was added to about 125 grams of the copoly(ethylene-dodecanoate)-copoly-(ethylene-fumarate) crystalline resin thus produced. The resin was dissolved by heating to about 65° C. on a hot plate and stirring at about 200 rpm. In a separate 4 liter glass reactor vessel was added about 4.3 grams of TAYCA POWER surfactant (from Tayca Corporation (Japan), a branched sodium dodecyl benzene sulfonate) (about 47% aqueous solution), about 2.2 grams sodium bicarbonate (for acid number of approximately 12 meq/KOH) and about 708.33 grams of deionized water. This aqueous solution was heated to about 65° C. on a hot plate stirring at about 200 rpm.

The dissolved resin in ethyl acetate mixture was slowly poured into the 4 liter glass reactor containing the aqueous solution with homogenization at about 4,000 rpm. The homogenizer speed was then increased to about 10,000 rpm and left for about 30 minutes. The homogenized mixture was placed in a heat jacketed PYREX distillation apparatus, with stirring at about 200 rpm. The temperature was ramped up to about 80° C. at about 1° C./minute. The ethyl acetate was distilled from the mixture at about 80° C. for about 120 minutes. The mixture was cooled to below about 40° C. then screened through a 20 micron screen. The mixture was pH adjusted to about 7 using 4% NaOH aqueous solution and centrifuged. The resulting resin included about 21% solids by weight in water, with a volume average diameter of about 108 nanometers as measured with a HONEYWELL MICROTRAC® UPA150 particle size analyzer.

Examples 3-6

An emulsion aggregation toner was prepared having about 82% of the polyester-photoinitiator resin of Example 1, about 12% of the crystalline polyester resin of Example 2, and about 6% of a cyan pigment, Pigment Blue 15:3. The toner had about 28% of the polyester-photoinitiator resin in the shell.

A 2 liter kettle was charged with about 220.4 grams of the polyester emulsion of Example 1 (about 24.5% solids and having a particle size of about 139 nm). To this was added about 40 grams of a cyan pigment, Pigment Blue 15:3 in a dispersion (about 15% solids available from Sun Chemicals), about 175 grams of water, about 51.7 grams of the crystalline resin of Example 2 (about 21% solids in water), and about 2.9 grams of DOWFAX™ 2A1 surfactant (an alkyldiphenyloxide disulfonate from the Dow Chemical Company (about 47.1% aqueous solution)), with stirring at about 100 rpm. To this was then added 0.3 M nitric acid solution, until a pH of about 4.2 was achieved, followed by homogenizing at about 2,000 rpm. To this was added aluminum sulfate (about 0.5 ppH), and the homogenizer was increased to about 4200 rpm at the end of the aluminum sulfate addition.

The mixture was then stirred at about 450 rpm with an overhead stirrer and placed in a heating mantle. The temperature was increased to about 30° C. over about a 30 minute period, during which period the particles grew to just below 3 microns.

The shell solution, including about 114.3 grams of the polyester emulsion of Example 1 along with about 50 grams water and about 1.2 grams of DOWFAX™2A1 surfactant was pH adjusted using 0.3 M nitric acid to a pH of about 4.2. This shell solution was then added to the 2 liter kettle. The temperature was then increased in 2° increments until a particle size of about 3.5 microns was achieved. This occurred at around 38° C. A solution including sodium hydroxide in water (about 4% by weight of NaOH) was added to freeze the size (prevent further growth) until the pH of the mixture was about 4.

Following this, about 1.6 grams (0.75 ppH) of a chelating agent, EDTA, was added to remove the aluminum and the pH was further adjusted using 4% NaOH to 7.2. During these additions, the stirrer speed was gradually reduced to about 160 rpm. The mixture was then heated to about 63° C. over about 60 minutes, and further to about 70° C. over about 30 minutes. The pH was decreased by increments of about 0.2 pH units by dropwise addition of an aqueous buffer solution of sodium acetate and acetic acid (original buffer pH adjusted to about 5.9 with acetic acid to achieve desired buffer ratio). These pH decreases occurred at about 44° C., about 50° C., about 56° C., about 62° C., and about 68° C., to reach a final pH of about 6.2. The mixture was set to coalesce at a final temperature of about 70° C. and at a pH of about 6.2. The resulting toner particles were of spherical morphology and displayed a size of about 3.68 microns with a GSD of about 1.21.

A full color set of ultra-low melt UV curable toners were prepared (Examples 4-6) utilizing the same components and procedure as described above for Example 3, with different pigments as outlined in Table 1 below.

TABLE 1

Full Color Set of UV Curable ULM Toners

| Example | Color | P.S. (Vol) | GSD (Vol) | GSD (Num) | Circularity | Pigment Loading | Amorphous resin!UV PS | Crystalline polyester PS |
|---|---|---|---|---|---|---|---|---|
| 3 | Cyan | 3.68 | 1.22 | 1.25 | 0.959 | 6 | 135 nm | 125 nm |
| 4 | Black | 3.42 | 1.21 | 1.23 | 0.971 | 5.5 | 119 nm | 125 nm |
| 5 | Yellow | 3.53 | 1.23 | 1.25 | 0.96 | 7 | 119 nm | 125 nm |
| 6 | Magenta | 3.57 | 1.25 | 1.28 | 0.961 | 10 | 125 nm | 125 nm |

Fusing

In addition to Examples 3 to 6, several other toner designs were tested for comparison purposes. The list of samples tested is as follows:

1) Xerox i-Gen3 Cyan production toner;

2) Xerox Docucolor 252 Cyan Toner; and

3) Xerox Docucolor 700 Cyan Toner

Non-contact fusing of the images was achieved by a single pass under a radiant infrared (IR) heater. The IR emitters used in the test fixture were two Heraerus twin Carbon (2 micron wavelength) tube lamps, and two Heraerus twin Hybrid (2 micron & 1 micron wavelength) tube lamps. Print samples were carried under the IR module at 74 mm/second or 124 mm/second. (Note: Faster process speeds were possible with additional lamp modules—a common industry practice. In addition, while the original purpose of the photo-initiator was for it to enable a UV curable toner, the UV lamp was not on for these tests.)

Unfused images on Xerox 120 gsm Digital Coated Gloss papers (Xerox P/N 3R11450) were made using a modified DC12 color copier/printer from Xerox Corporation (referred to herein as a Docucolor 252 printer). By adjusting the development bias and sending the print through the Docucolor 252 printer multiple times, the target TMA of 0.5±0.02 mg/cm$^2$ or 1±0.02 mg/cm$^2$ was achieved.

Crease Test

The measurement of how well a toner adhered to the substrate was carried out using a standard crease area test. The substrate was folded in half where toner/image was present on the page. A standard crease area tool (metal cylinder, mass=960 grams) was rolled along the folded section. The sheet was then unfolded and fractured toner was removed by wiping the fold with a cotton ball. Using an image analysis system, the amount of toner that had been removed from the paper surface was measured and correlated to crease area standards. The current target crease area measurement for normal paper is about 85 CA units or less. A summary plot of the crease area results is shown in FIG. 1. Acceptable adhesion to the paper was found for all test conditions (low or high TMA, 76 mm/second or 124 mm/second, carbon lamps or hybrid lamps) with four toners (Example 3, Docucolor 252, Docucolor 700 and i-Gen-3).

Print Gloss

Figure 2:
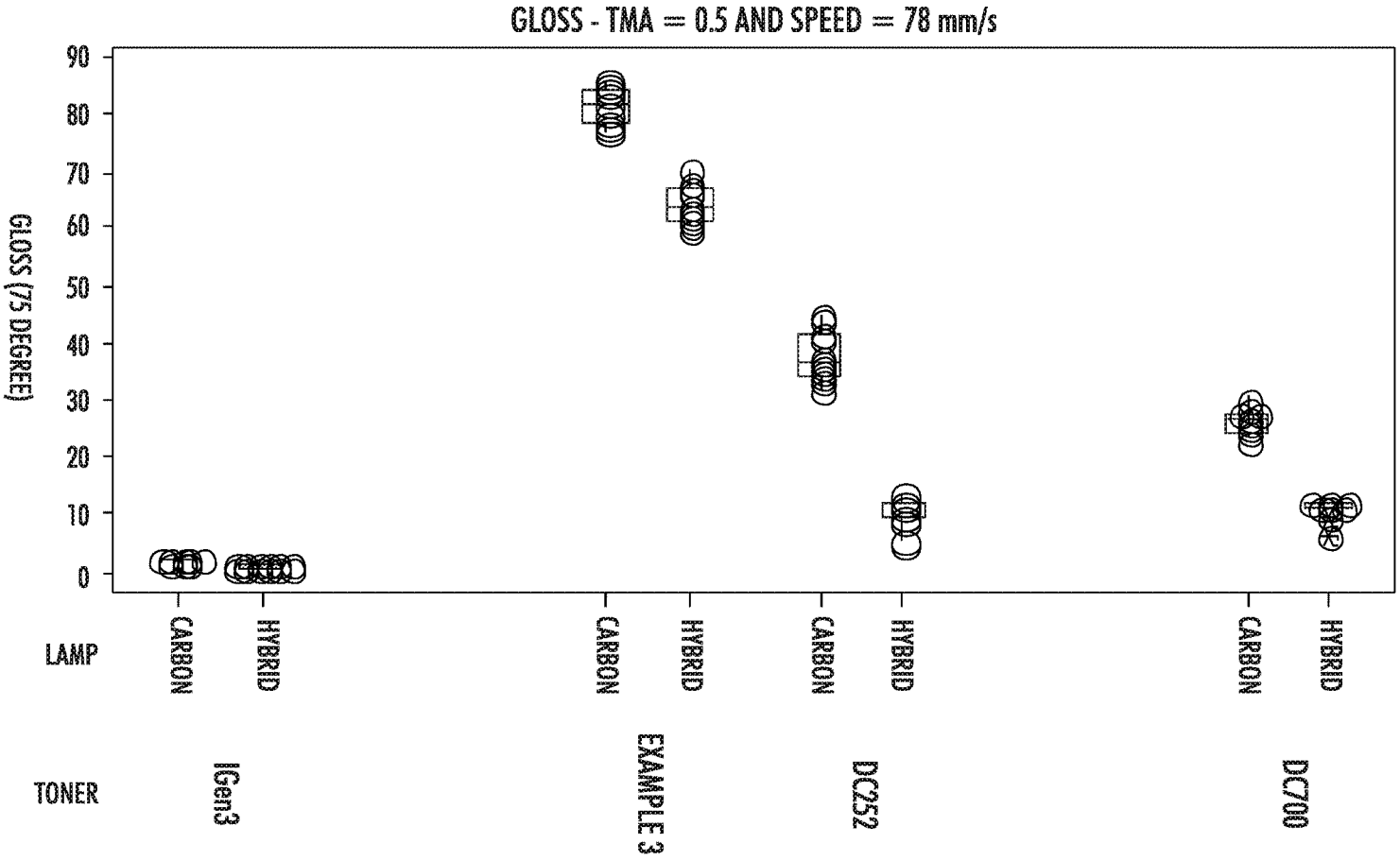
FIG. 2 is a graph depicting gloss of a toner of the present disclosure and comparison toners.

Gloss of the fused prints on Xerox 120 gsm Digital Coated Gloss papers was measured using a BYK Gardner 75 degree gloss meter. A set of six readings (three readings with the gloss meter parallel to the process direction and 3 readings with the gloss meter perpendicular to the process direction) were measured for each toner at all the test conditions. The results are set forth in FIG. 2, which summarizes the data collected at 78 mm/second for the low (0.5) TMA print samples and both sets of lamp modules. iGen3 was very matte. Docucolor 252 and 700 were matte or had low gloss depending on the IR lamp that was used. The toner of Example 3 was very glossy with print gloss of from about 70 Gardner gloss units (ggu) to about 90 ggu.

Figure 3:
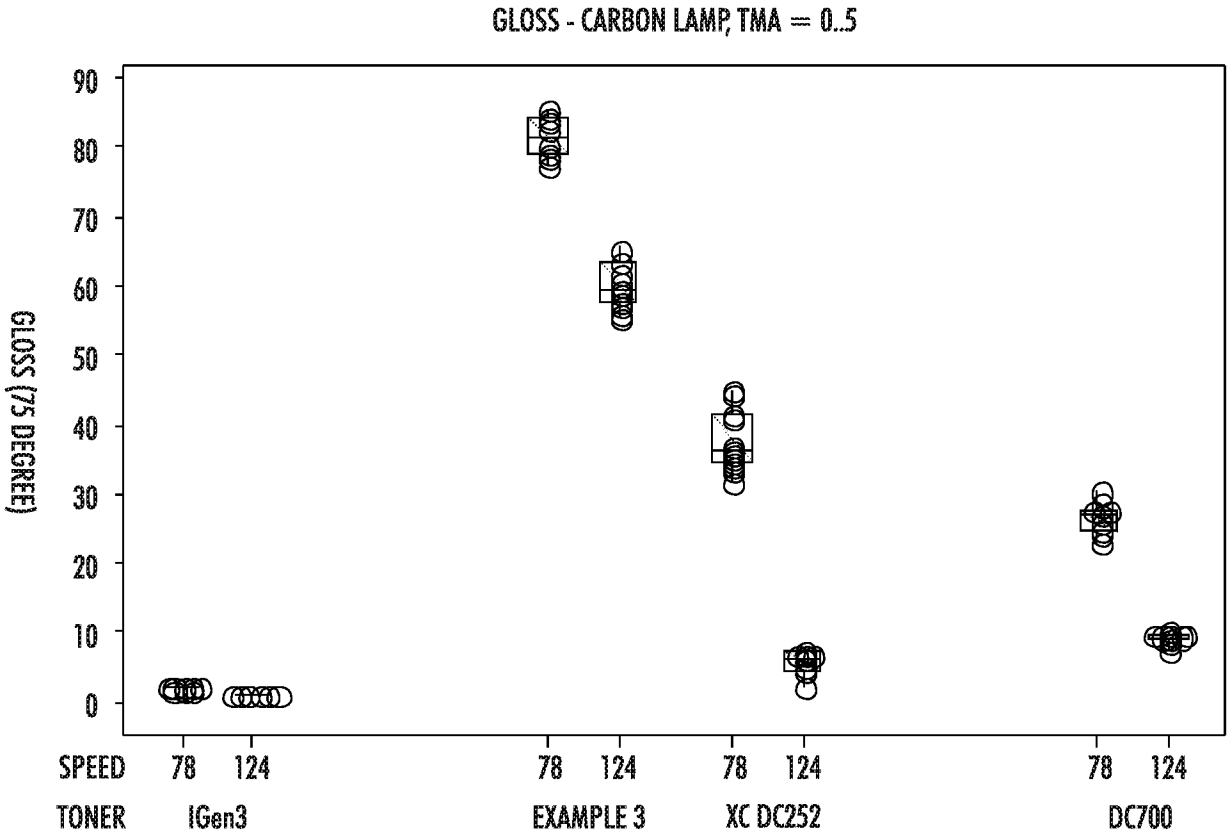
FIG. 3, is a graph depicting gloss of a toner of the present disclosure and comparison toners.

FIG. 3 is a graph of the gloss obtained for prints made at 0.5 TMA and fused using the Carbon lamp module at two different process speeds. As the speed was increased from 74 mm/second to 124 mm/second, the print gloss dropped for four of the toners. The control toner (iGen3) had such low print gloss to start, ~1 ggu, that gloss could not be reduced any further and the toner could be easily rubbed off the print. Print gloss of Docucolor 252 and 700 toners was from about 30 ggu to less than about 10 ggu. The toner of Example 3 started out with gloss of about 80 ggu, which was reduced to about 60 ggu (still glossy to the eye) at the faster process speed (124 mm/second). The faster process speed translated to a 0.75 second dwell time under the IR lamp module.

The toner particles of Example 3, which possessed the incorporated photo-initiator, were able to produce glossy images with acceptable adhesion to the substrate when fused using IR heat lamps at 124 mm/second. Faster process speeds (up to about 468 mm/second) could be attained by adding additional heat lamp modules and optimizing the IR lamp modules used to heat the toner.

Thus, in accordance with the present disclosure, a unique combination of amorphous resin, crystalline resin and initiator resulted in a non-contact fusing toner with high print gloss.

From the above, and in accordance with the present disclosure, a full color set of low melt UV curable toners were prepared and the cyan toner from this set was fused. Suitable conditions to generate small size particles were found to be about 110 run emulsion size, aggregant concentration of about 0.5 ppH of aluminum sulfate, and about 10% solids content. The experimental toner had similar glass transition temperature to other toners tested, which was acceptable. The other toners designs used as comparative examples produced matte or lower gloss prints than the glossy prints obtained with toners of the present disclosure.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A process comprising:

forming an emulsion comprising at least one polymeric resin comprising particles of a size of from about 80 nanometers to about 120 nanometers;

contacting the emulsion with an optional colorant and an optional wax;

aggregating the particles by contacting the particles with from about 0.01 to about 0.35 parts per hundred of an aggregating agent to form aggregated particles;

contacting the aggregated particles with at least one unsaturated polymeric resin in combination with a photoinitiator to form a shell over the aggregated particles;

coalescing the aggregated particles to form toner particles of a size of from about 3 microns to about 4 microns; and recovering the toner particles.

2. The process according to claim 1, wherein the emulsion comprising at least one polymeric resin, has a solids content of from about 15 to about 50% solids in water.

3. The process according to claim 1, wherein the at least one polymeric resin comprises an unsaturated polyester resin and the aggregating agent is selected from the group consisting of aluminum sulfate, polyaluminum chloride, polyaluminum bromide, polyaluminum fluoride, polyaluminum iodide, polyaluminum silicate, polyaluminum sulfosilicate aluminum chloride, aluminum nitrite, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof.

4. The process according to claim 1, wherein the at least one polymeric resin comprises a crystalline polyester having a number average molecular weight of from about 1,000 to about 50,000, a weight average molecular weight of from about 2,000 to about 100,000, and a molecular weight distribution (Mw/Mn) of from about 2 to about 6.

5. The process according to claim 1, wherein the at least one polymeric resin comprises an amorphous polyester resin of the formula:

(I)

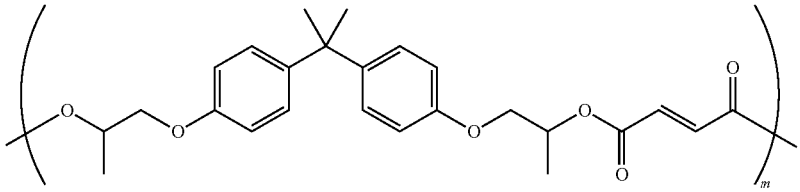

wherein m may be from about 5 to about 1,000, in combination with a crystalline polyester resin of the formula:

(II)

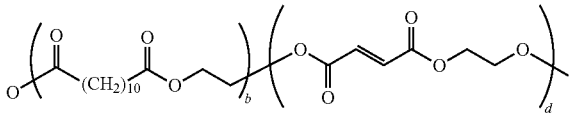

wherein b is from about 5 to about 2,000, and d is from about 5 to about 2,000.

6. The process according to claim 1, wherein the photoinitiator is selected from the group consisting of hydroxycyclohexylphenyl ketones, other ketones, benzoins, benzoin alkyl ethers, benzophenones, trimethylbenzoylphenylphosphine oxides, azo compounds, anthraquinones, substituted anthraquinones, other substituted or unsubstituted polynuclear quinines, acetophenones, thioxanthones, ketals, acylphosphines, and mixtures thereof.

7. The process according to claim 1, wherein the photoinitiator is selected from the group consisting of alpha-amino ketone, 4-(2-hydroxyethoxy)phenyl-(2-hydroxy-2-propyl) ketone, 2,4,6-trimethylbenzophenone, 4-methylbenzophenone, 2,4,6-trimethylbenzoyl-diphenylphosphine oxide, phenylbis(2,4,6-trimethylbenzoyl)phosphine oxide, alkyl substituted or halo substituted anthraquinones, 2-hydroxy-2-methyl-l-phenyl-propan-l-one, 2-isopropyl-9H-thioxanthen-9-one, 2-Hydrox-4'-hydroxyethoxy-2-methylpropiophenone, 1-hydroxycyclohexylphenyl ketone, ethyl-2,4,6-trimethylbenzoylphenylphosphinate, and mixtures thereof.

8. The process according to claim 1, wherein the at least one polymeric resin is present in an amount of from about 65 percent by weight to about 95 percent by weight of the toner particles and the photoinitiator is present in an amount of from about 0.5 percent by weight to about 15 percent by weight of the toner particles.

9. The process according to claim 1, wherein the toner particles possess a Number Average Geometric Standard Deviation or Volume Average Geometric Standard Deviation of from about 1.05 to about 1.55.

10. A process comprising:

forming an emulsion comprising at least one polymeric resin comprising particles of a size of from about 80 nanometers to about 120 nanometers;

contacting the emulsion with an optional colorant and an optional wax;

aggregating the particles by contacting the particles with from about 0.01 to about 0.35 parts per hundred of an aggregating agent to form aggregated particles;

contacting the aggregated particles with at least one unsaturated polymeric resin in combination with a photoinitiator to form a shell over the aggregated particles;

coalescing the aggregated particles to form toner particles of a size of from about 3 microns to about 4 microns;

recovering the toner particles;

applying the toner particles to a substrate; and fusing the toner particles to the substrate by non-contact fusing to form an image on the substrate, wherein the toner possesses a gloss of from about 20 ggu to about 100 ggu.

11. The process according to claim 10, wherein the emulsion comprising at least one unsaturated polymeric resin has a solids content of from about 15 to about 50% solids in water.

12. The process according to claim 10, wherein the at least one polymeric resin comprises an amorphous polyester resin.

13. The process according to claim 10, wherein the at least one polymeric resin comprises a crystalline polyester having a number average molecular weight of from about 1,000 to about 50,000, a weight average molecular weight of from about 2,000 to about 100,000, and a molecular weight distribution (Mw/Mn) of from about 2 to about 6.

14. The process according to claim 10, wherein the aggregating agent is selected from the group consisting of aluminum sulfate, polyaluminum chloride, polyaluminum bromide, polyaluminum fluoride, polyaluminum iodide, polyaluminum silicate, polyaluminum sulfosilicate aluminum chloride, aluminum nitrite, potassium aluminum sulfate, and combinations thereof, and wherein the photoinitiator is selected from the group consisting of hydroxycyclohexylphenyl ketones, other ketones, benzoins, benzoin alkyl ethers, benzophenones, trimethylbenzoylphenylphosphine oxides, azo compounds, anthraquinones, substituted anthraquinones, other substituted or unsubstituted polynuclear quinines, acetophenones, thioxanthones, ketals, acylphosphines, and mixtures thereof.

15. The process according to claim 10, wherein the at least one polymeric resin is present in an amount of from about 65 percent by weight to about 95 percent by weight of the toner particles and the photoinitiator is present in an amount of from about 0.5 percent by weight to about 15 percent by weight of the toner particles.

16. The process according to claim 10, wherein the non-contact fusing occurs by exposing the toner particles to infrared light at a wavelength of from about 750 nm to about 2500 nm for a period of time of from about 30 milliseconds to about 3 seconds.

17. The process according to claim 10, wherein the toner particles possess a Number Average Geometric Standard Deviation or Volume Average Geometric Standard Deviation of from about 1.05 to about 1.55.

* * * * *